US009856754B1

(12) United States Patent
Pasch

(10) Patent No.: US 9,856,754 B1
(45) Date of Patent: Jan. 2, 2018

(54) CASCADED RECOMPRESSION CLOSED BRAYTON CYCLE SYSTEM

(71) Applicant: Sandia Corporation, Albuquerque, NM (US)

(72) Inventor: James J. Pasch, Albuquerque, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 0 days.

(21) Appl. No.: 15/489,338

(22) Filed: Apr. 17, 2017

Related U.S. Application Data

(62) Division of application No. 14/266,184, filed on Apr. 30, 2014, now Pat. No. 9,624,793.

(60) Provisional application No. 61/818,218, filed on May 1, 2013.

(51) Int. Cl.

| | |
|---|---|
| ***F01K 7/16*** | (2006.01) |
| ***F01K 19/04*** | (2006.01) |
| ***F01K 13/02*** | (2006.01) |
| ***F01K 25/10*** | (2006.01) |
| ***F01K 11/00*** | (2006.01) |
| ***F01K 23/04*** | (2006.01) |

(52) U.S. Cl.
CPC ..... *F01K 7/16* (2013.01); *F01K 11/00* (2013.01); *F01K 13/02* (2013.01); *F01K 19/04* (2013.01); *F01K 23/04* (2013.01); *F01K 25/103* (2013.01)

(58) Field of Classification Search
CPC ..... F02C 7/08; F02C 7/10
USPC ..... 60/650, 659, 682–684
See application file for complete search history.

(56) References Cited

U.S. PATENT DOCUMENTS

2012/0131921 A1* 5/2012 Held ..... F01K 25/08 60/671

* cited by examiner

*Primary Examiner* — Mark Laurenzi
*Assistant Examiner* — Mickey France
(74) *Attorney, Agent, or Firm* — Daniel J. Jenkins

(57) ABSTRACT

The present disclosure is directed to a cascaded recompression closed Brayton cycle (CRCBC) system and method of operation thereof, where the CRCBC system includes a compressor for compressing the system fluid, a separator for generating fluid feed streams for each of the system's turbines, and separate segments of a heater that heat the fluid feed streams to different feed temperatures for the system's turbines. Fluid exiting each turbine is used to preheat the fluid to the turbine. In an embodiment, the amount of heat extracted is determined by operational costs.

8 Claims, 3 Drawing Sheets

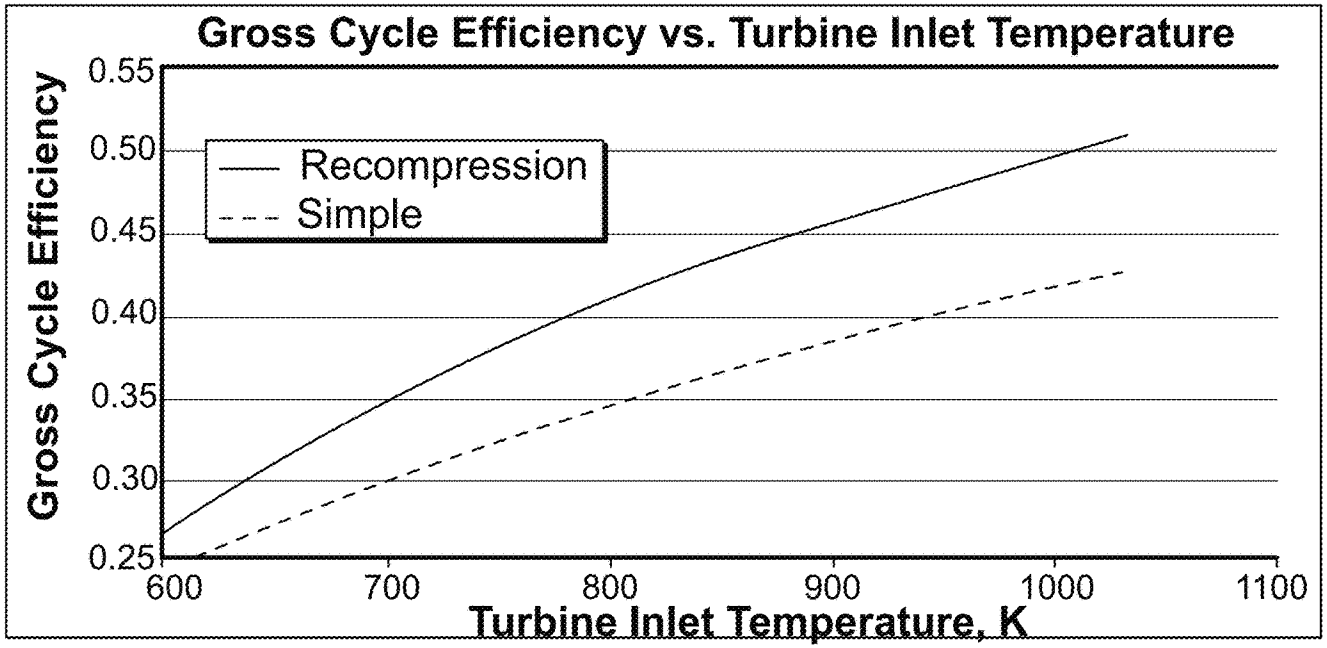

This plot shows the benefits of RCBC processes over simple cycles

| Parameter | Units | Value |
|---|---|---|
| Main compressor inlet temperature | K | 305.5 |
| Main compressor inlet pressure | MPa | 7.6 |
| Turbine inlet temperature | K | Variable |
| Turbine inlet pressure | MPa | 19 |
| Low temp recuperator pinch temp at cold end | ΔK | 10 |
| High temp recuperator pinch temp at cold end | ΔK | 10 |
| Turbine efficiencies (both) | - | 0.87 |
| Compressor efficiencies (both) | - | 0.85 |
| Fractional pressure drop through each major component | ΔP/P | 0.008 |

Figure 3

CASCADED RECOMPRESSION CLOSED BRAYTON CYCLE SYSTEM

CROSS-REFERENCE TO RELATED APPLICATIONS

This application is a divisional patent application of U.S. patent application Ser. No. 14/266,184, entitled "A CASCADED RECOMPRESSION CLOSED BRAYTON CYCLE SYSTEM," filed Apr. 30, 2014, which claims benefit of U.S. Provisional Patent Application No. 61/818,218, "A CASCASED RECOMPRESSION CLOSED BRAYTON CYCLE SYSTEM", filed May 1, 2013, the discloses of which are incorporated by reference herein in their entireties.

GOVERNMENT RIGHTS

The Government has rights to this invention pursuant to Contract No. DE-AC04-94AL85000 awarded by the U.S. Department of Energy.

FIELD

The invention relates generally to a method of controlling a closed split flow recompression Brayton cycle power generation system and more particularly to a method of controlling a closed split flow recompression Brayton cycle power generation system that applies the efficiency of recompression closed Brayton cycle (RCBC) technology to separate segments of the heater of that system.

BACKGROUND OF THE INVENTION

Due to environmental concerns as well as increasing population, environmentally friendly and efficient power generation systems are desired. While there have recently been advances in systems that utilize renewable resources, such as solar power, wind, geothermal energy, and the like, efficiencies of such systems trail conventional turbine-based power generation systems, and costs of building such systems are relatively high. Moreover, generally, systems that utilize renewable resources output variable amounts of electrical power depending upon environmental factors, such as cloud cover and wind speeds.

Supercritical Brayton cycle power generation systems have been proposed and theorized as efficient power generation systems. Advantages of supercritical Brayton cycle power generation systems include the utilization of an environmentally friendly, naturally occurring compound such as carbon dioxide. Additional advantages of supercritical Brayton cycle power generation systems include a relatively small footprint when compared to conventional turbine-based power generation systems. Moreover, supercritical Brayton cycle power generation systems have been theorized to have efficiencies that meet or exceed efficiencies of conventional power generation systems.

Supercritical Brayton cycle power generation systems offer a promising approach to achieving higher efficiency and more cost-effective power conversion when compared to existing steam-driven power plants, and also perhaps gas turbine power plants. A supercritical Brayton cycle power generation system is a power conversion system that utilizes a single-phase fluid operating near the critical temperature and pressure of such fluid. Generally, two types of power conversion cycles have been proposed: a recuperated Brayton cycle and a recompression Brayton cycle. Other types of power cycles, such as a power take off cycle, cycles with reheat or inter-cooling, split-flow compressor discharge cycles that heat a fraction flow rather than recuperate it, or cycles that feed all or a portion of the high pressure flow directly to a turbine while the low pressure flow leg provides the heating can also be utilized, wherein such cycles employ a Brayton cycle.

A problem for open cycle heat sources in recompression closed Brayton cycles (RCBCs) is that while the recompression cycles may be very efficient, the cycle does not extract very much heat from the open cycle heat source. For example, the heat source flow may come in at 900° C., and only be reduced to 700° C. at the discharge of the heating heat exchanger. There is a great deal of energy NOT being extracted from the heat source flow by the RCBC. And this is because the recuperation in the RCBC is so efficient that the fluid entering the heater is very hot.

A need remains, therefore, for an RCBC system and method of operation that extracts as much heat from the heat source stream as is economically reasonable. This invention applies the design characteristics of RCBC's in such a way as to meet this need. In general, the concept applies separate RCBC flow paths at the high temperature portion of the system, and retains the single recompression flow path to each of the two compressors. The result is a cycle that capitalizes on the efficiency benefits of RCBC technology while still extracting as much heat from the heat source stream as is desired

SUMMARY OF THE INVENTION

According to an embodiment of the disclosure, a cascaded recompression closed Brayton cycle system is disclosed that includes a first turbine operating at a first operating temperature and receiving a first turbine feed stream at a first turbine inlet and discharging a first turbine discharge stream at a first turbine discharge stream temperature; a second turbine operating at a second operating temperature and receiving a second turbine feed stream at a second turbine inlet and discharging a second turbine discharge stream at a second turbine discharge stream temperature; a first recuperator where the first turbine discharge stream transfers heat to the first turbine feed stream; and a second recuperator where the second turbine discharge stream transfers heat to the second turbine feed stream.

According to an embodiment of the disclosure, a method of operating a cascaded recompression closed Brayton cycle system is disclosed that includes providing a first turbine feed stream to a first turbine operating at a first turbine operating temperature; compressing the first turbine feed stream to form a first turbine discharge stream; preheating the first turbine feed stream with the first turbine discharge stream in a first recuperator; providing a second turbine feed stream to a second turbine operating at a second turbine operating temperature; compressing the second turbine feed stream to form a second turbine discharge stream; preheating the second turbine feed stream with the second turbine discharge stream in a second recuperator; and combining the first turbine discharge steam and the second turbine discharge stream to form a compressor feed stream.

An object of the present invention is to reduce the cost by improving the efficiency of a Brayton cycle power generation system.

Another object of the present invention is to reduce costs by reducing the number of compressors required to effect multiple recompression cycles).

Another object of the present invention is to reduce costs by implementing smaller turbomachines compared to power cycles in common use today.

An advantage of the present invention is to leverage the benefits of reduced compression work associated with a fluid near its critical temperature, and a high degree or internal recuperation associated with a cycle that operates outside of the two-phase dome and, thus, retains a sensible temperature gradient that drives heat recuperation).

Another advantage of the present invention is to maximize the amount of thermal energy extracted from an open heat source, to an economically optimized extent.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instruments and combinations particularly pointed out in the appended claims.

DESCRIPTION OF THE DRAWINGS

FIG. 3 shows a comparison of an embodiment of a cascaded recompression closed Brayton cycle system and a simple recompression closed Brayton cycle system.

DETAILED DESCRIPTION OF THE INVENTION

The present disclosure is directed to a cascaded recompression closed Brayton cycle (CRCBC) system and method of operation thereof, where the CRCBC system includes a compressor for compressing the system fluid, a separator for generating fluid feed streams for each of the system's turbines, and separate segments of a heater that heat the fluid feed streams to different feed temperatures for the system's turbines. The system may operate at supercritical or below supercritical fluid conditions. Fluid exiting each turbine is used to preheat the fluid to the turbine. In an embodiment, the amount of heat extracted is determined by operational costs. In an embodiment, the CRCBC system includes three turbines operating at three different temperatures. The fluid exiting the turbines is recombined and used as the feed fluid to the recompressor. In an embodiment, the feed fluid may be used to preheat the turbine feed fluid before it is heated to the turbine inlet temperature.

The proposed cycle applies the efficiency of RCBC technology to separate segments of the heat source heat exchanger. After the fluid is compressed, separate flow streams are generated to extract as much heat energy out of the heat source stream as is economically reasonable.

The fluid may be any fluid capable of expanding and driving a turbine and being compressed. In an embodiment, the fluid may be selected from a group including ammonia, ethane, xenon, trichlorofluoromethane, and carbon dioxide. In an embodiment, the fluid may be supercritical carbon dioxide ($SCO_2$).

Figure 1:
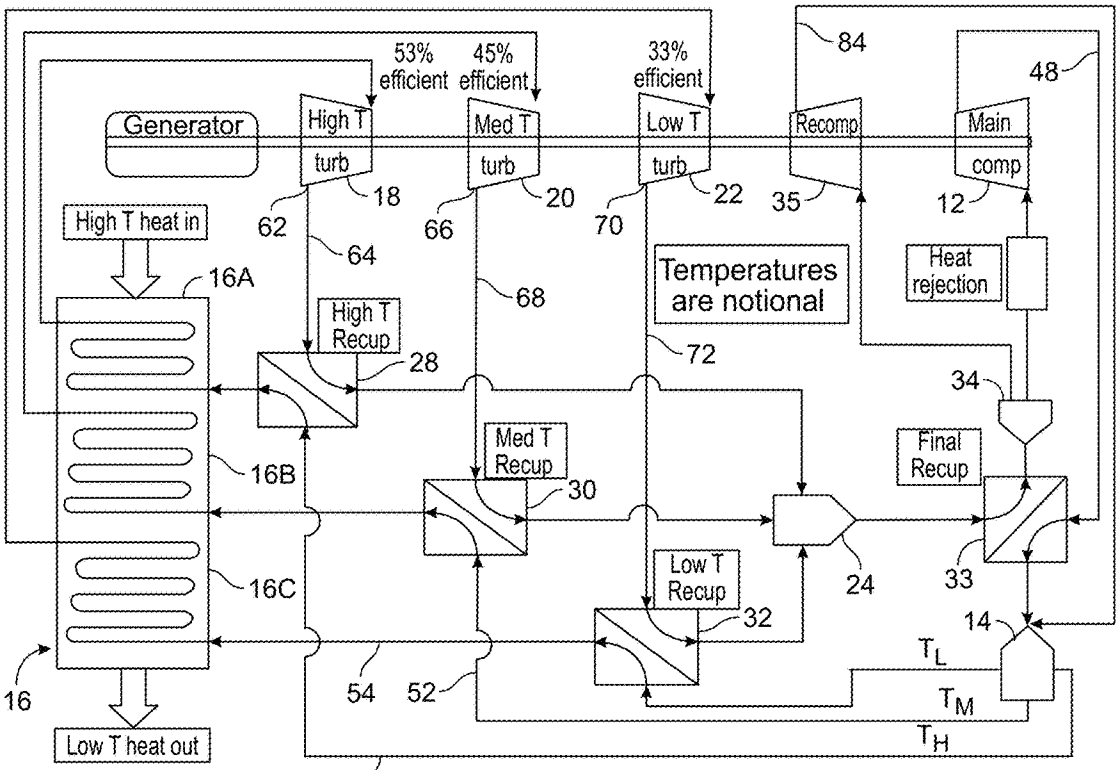
FIG. 1 shows an embodiment of a cascaded recompression closed Brayton cycle system according to an embodiment of the invention

FIG. 1 illustrates an embodiment of a CRCBC system (system) 10 according to the invention. As can be seen in FIG. 1, the system 10 includes a first compressor 12, a first splitter 14, a heater 16, a first turbine 18, a second turbine 20, a third turbine 22, a mixing tank 24, a heat exchanger 26, a first recuperator 28, a second recuperator 30, a third recuperator 32, a final recuperator 33, a second splitter 34, a second compressor 35, and a generator 36. The system 10 further includes a shaft 38 driven by the first, second and third turbines 18, 20, 22. The shaft 38 provides power to the first and second compressors 12, 34. In this exemplary embodiment, the shaft 38 is connected to and powers a generator 40. In another embodiment, the shaft 38 may provide power to another device, such as, but not limited to a motor, generator, or any mechanical device powered through a power takeoff.

As can be seen in FIG. 1, the first compressor 12 includes an outlet 42 where it receives a fluid from a first piping 44. The first compressor 12 is driven by the shaft 38 to compresses the fluid. The fluid exits the first compressor 12 via an outlet 46 to a second piping 48. The second piping 48 provides the fluid to the final recuperator 33 where the fluid is heated. The final recuperator 33, like the first, second and third recuperators 28, 30, 32, is a heat exchanger capable of transferring heat from one fluid stream to another.

After the fluid exits the final recuperator 33, but fluid enters the first splitter 14 where the fluid is separated into a third piping 50, a fourth piping 52, and a fifth piping 54. The third piping 50 provides the fluid to the first recuperator 28 where the fluid is heated. The fluid exits the first recuperator 28 and is provided to a first portion 16A of the heater 16, where the fluid is further heated. The fluid is then provided to an inlet 56 of the first turbine 18.

The fourth piping 52 provides fluid to the second recuperator 30 where it is heated. The fluid exits the second recuperator 30 and is provided to a second portion 16B of the heater 16, where the fluid is further heated. The fluid is then provided to an inlet 58 of the second turbine 20.

The fifth piping 54 provides fluid to the third recuperator 32 where it is heated. The fluid exits the third recuperator 32 and is provided to a third portion 16C of the heater 16, where the fluid is further heated. The fluid is then provided to an inlet 60 of the third turbine 22

In this exemplary embodiment, the heater 16 is a heat exchanger that receives a second fluid at a high temperature for heat exchange with the fluid in the third, fourth and fifth pipings 50, 52, 54. The heater 16 is configured to exchange heat from the hottest temperature of the second fluid with the fluid in the third piping 50 in the first portion 16A, and then to the fluid in the fourth piping 52 at a lower temperature, and then to the fluid in the fifth piping 54 at an even lower temperature. In such a manner, the fluid in the third piping 50 exiting the heater is hotter than the fluid in the fourth piping 52 exiting the heater, which is hotter than the fluid in the fifth piping 54 exiting the heater. The heated second fluid may come from any heat source producing a heated fluid discharge. In an embodiment, the heated fluid may be at a temperature between about (300° C. and 1100° C. In another embodiment, the heated fluid may be at a temperature between about 500° C. and 950° C. The heat source may be, but is not limited to a nuclear reactor, fossil fuel combustor, concentrated solar power, geothermal, waste heat from a primary power cycle, or waste process heat.

After fluid is expanded in the first turbine 18, the fluid exits an outlet 62 of the first turbine 18 into a sixth piping 64. The sixth piping 64 provides the fluid to the first recuperator 28 where the fluid exchanges heat with fluid in the third piping 50 before that fluid enters the heater 16. The fluid in the sixth piping 64 is at a greater temperature than the fluid in the third piping 50. In such a manner, the first recuperator 28 facilitates the fluid in the sixth piping 64 preheating the fluid in the third piping 50 before it enters the heater 16, thereby recovering heat from the fluid in the sixth piping 64.

After fluid is expanded in the second turbine 20, the fluid exits an outlet 66 of the second turbine 20 into a seventh piping 68. The seventh piping 68 provides the fluid to the second recuperator 30 where the fluid exchanges heat with fluid in the fourth piping 52 before it enters the heater 16. The fluid in the seventh piping 68 is at a greater temperature than the fluid in the fourth piping 52. In such a manner, the second recuperator 28 facilitates the fluid in the seventh piping 68 preheating the fluid in the fourth piping 52 before it enters the heater 16, thereby recovering heat from the fluid in the seventh piping 68.

After fluid is expanded in the third turbine 22, the fluid exits an outlet 70 of the third turbine 22 into an eighth piping 72. The eighth piping 72 provides the fluid to the third recuperator 32 where the fluid exchanges heat with fluid in the fifth piping 54 before it enters the heater 16. The fluid in the eighth piping 72 is at a greater temperature than the fluid in the fifth piping 54. In such a manner, the third recuperator 32 facilitates the fluid in the eighth piping 72 preheating the fluid in the fifth piping 54 before it enters the heater 16, thereby recovering heat from the fluid in the eighth piping 72.

The mixing tank 24 combines fluid from the sixth, seventh and eighth pipings 64, 66, 68 and provides the fluid to a ninth piping 74. The ninth piping 74 provides the fluid to final recuperator 33 before providing the fluid to a second splitter 34. In the final recuperator, the fluid in the ninth piping 74 transfers heat to compressed fluid from the first compressor 12 in the second piping 48 before that compressed fluid is split at the first splitter 14. The fluid in the ninth piping 74 being at a higher temperature than the fluid in the second piping 48.

After the fluid in the ninth piping 74 exits the final recuperator 33, the ninth piping provides the fluid to the second splitter 34 where the fluid is split into a tenth piping 76 and an eleventh piping 78. The tenth piping 76 provides fluid to an inlet 80 of the second recompressor, and the eleventh piping 78 provides fluid to heat exchanger 26.

The second recompressor 35, which may be referred to as a recompressor, compresses the fluid and exits the compressed fluid via an outlet 82 to a twelfth piping 84. Twelfth piping 84 provides fluid to be combined with fluid from the second piping 48 at the first splitter 14. In this exemplary embodiment, the fluid from the twelfth and second pipings 84, 48 are combined at an inlet 86 of the first splitter 14, but in another embodiment, the fluid from the twelfth and second pipings 84, 48 may be combined at any point after the fluid in the second piping 48 has passed through the final recuperator 33.

At the heat exchanger 26, the fluid from the eleventh piping 78 is cooled. The heat exchanger 26 then provides the cooled fluid to the first piping 44 to then be provided to the first compressor 12.

In this exemplary embodiment, the system 10 is shown with three turbines and associated recuperators, however, in other embodiments, the system 10 may include two or more turbines and associated recuperators.

Also in this exemplary embodiment, the system 10 is shown with a single heater 16, however, in other embodiments, the system 10 may include one or more heaters capable of heating fluid before that fluid enters the turbines.

Figure 2:
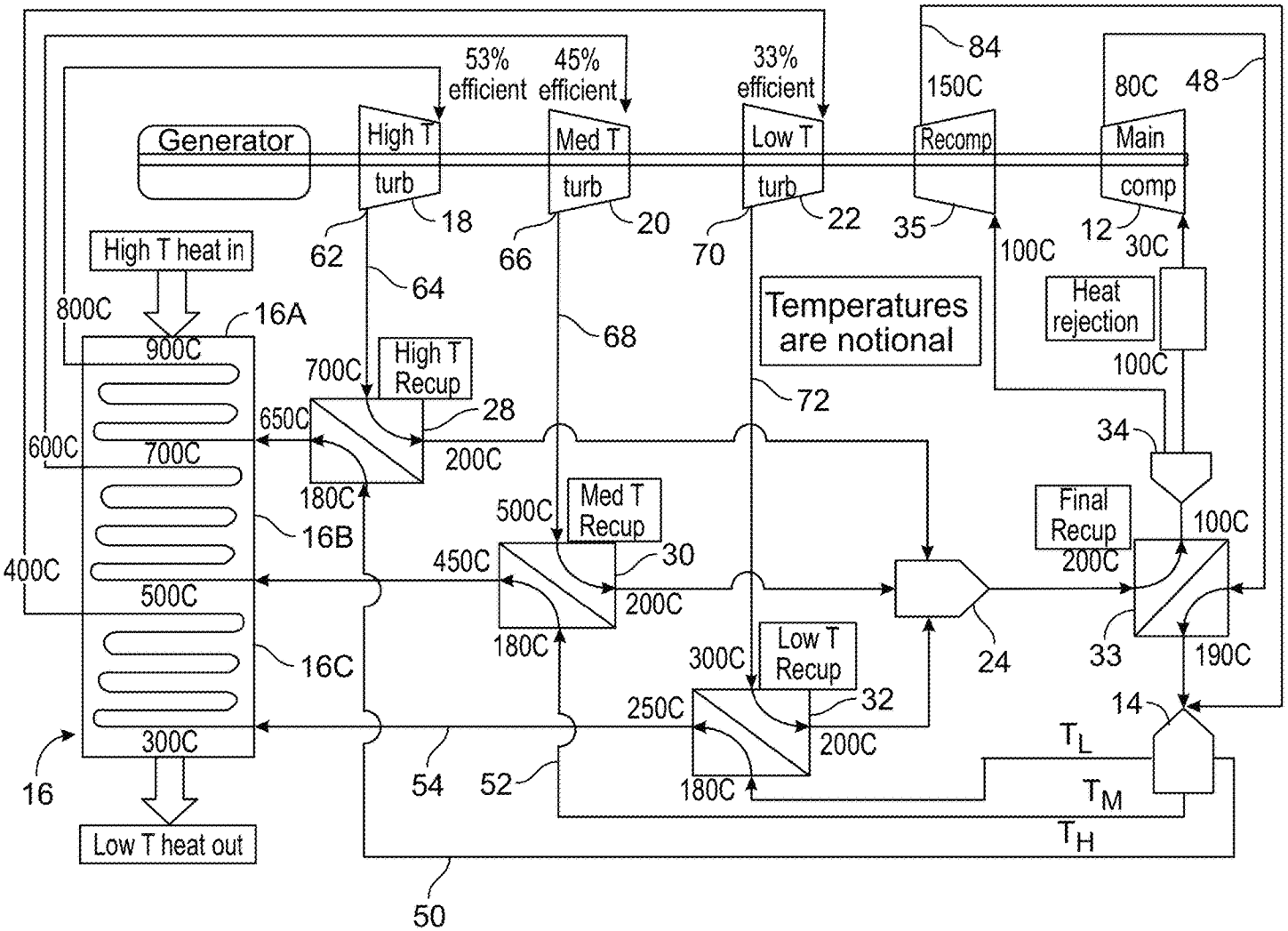
FIG. 2 shows another embodiment of a cascaded recompression closed Brayton cycle system according to an embodiment of the invention.

FIG. 2 shows an exemplary embodiment of system 10 operating at exemplary fluid temperatures. As can be seen in FIG. 2, the first, second and third turbines 18, 20, 22 are cascaded such that lower temperature fluid feed streams are provided to the inlets of the turbines operating at lower temperatures and consequently, lower temperature discharge streams are discharged. In this arrangement, the highest discharged streams are used to preheat the feed streams for each turbine.

FIG. 3 shows cycle efficiencies for the exemplary configuration shown in FIG. 2 compared to a simple RCBC system without heat recovery. As can be seen in FIG. 3, cycle efficiency declines as turbine inlet temperature declines, but acceptable efficiencies can be realized even at relatively low temperatures. It is these lower heat stream temperatures that a traditional RCBC neglects to capitalize on, and which an CRCBC does capitalize on. In the configuration shown in FIG. 1, there are 3 different turbine inlet temperatures of 673° K (400° C.), 873° K (600° C.), and 1073° K (800° C.). Interrogation of FIG. 2 shows that the corresponding gross cycle efficiencies for these 3 temperatures are 33%, 45% and 53% (extrapolating from FIG. 2), and the heat stream exhaust temperature is 573° K. The average CRCBC efficiency is roughly 44% (assuming equal mass flows in each stream). For a traditional RCBC, only the 1073° K flow stream would be generated, with a cycle efficiency of 53%, but the total amount of power would be much less than for the CRCBC, and the heat stream exhaust temperature will be 973° K. Thus, a great deal of useable heat energy is lost in a traditional RCBC.

There can be as many RCBC segments (which includes a dedicated recuperator and turbine section) at the hot end as is needed to optimize the system. The flow split between the cascaded streams can be optimized for desired objectives (max efficiency, max power generation, best economics, minimum installed cost, etc).

While more turbine sections and recuperators are necessary compared to a single RCBC, the compression end of the system is as simple as a single RCBC and accommodates the total flow. Cost savings are realized compared to entirely separate bottoming cycles.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A method of operating a cascaded recompression closed Brayton cycle system, comprising:

providing a first turbine feed stream to a first turbine operating at a first turbine operating temperature;

expanding the first turbine feed stream to form a first turbine discharge stream;

preheating the first turbine feed stream with the first turbine discharge stream in a first recuperator;

providing a second turbine feed stream to a second turbine operating at a second turbine operating temperature;

expanding the second turbine feed stream to form a second turbine discharge stream;

preheating the second turbine feed stream with the second turbine discharge stream in a second recuperator; and combining the first turbine discharge stream and the second turbine discharge stream to form a compressor feed stream;

splitting the compressor feed stream to form a first compressor feed stream and a second compressor feed stream;

providing the first compressor feed stream to a first compressor where the first compressor feed stream is compressed to form a first compressor discharge stream, and providing the second compressor feed stream to a second compressor where the second compressor feed stream is compressed to form a second compressor discharge stream;

combining the first and second compressor discharge streams to for a compressor discharge; and splitting the compressor discharge to form the first and second turbine feed streams.

2. The method of claim 1, further comprising:

heating the first compressor feed stream and the second compressor feed stream with one or more heaters after preheating the first compressor feed stream and the second compressor feed stream.

3. The method of claim 2, wherein heating is by a single heater.

4. The method of claim 1, further comprising: heating the first compressor discharge stream with the compressor feed stream.

5. The method of claim 1, further comprising:

providing a third turbine feed stream to a third turbine operating at a third turbine operating temperature;

expanding the third turbine feed stream to form a third turbine discharge stream; and preheating the third turbine feed stream with the third turbine discharge stream in a third recuperator.

6. The method of claim 1, wherein the first turbine operating temperature is greater than the second turbine operating temperature.

7. The claim 6, wherein the first turbine operating temperature is greater than the second turbine operating temperature, which is greater than the third turbine operating temperature.

8. The method of claim 1, further comprising:

driving a shaft driven by the first and second turbines, wherein the shaft is coupled to a power generation unit.

* * * * *